United States Patent [19]

Woods

[11] Patent Number: 4,658,686

[45] Date of Patent: Apr. 21, 1987

[54] MITER GAGE

[75] Inventor: Garry W. Woods, Dayton, Ohio

[73] Assignee: Shopsmith, Inc., Dayton, Ohio

[21] Appl. No.: 761,134

[22] Filed: Jul. 31, 1985

[51] Int. Cl.[4] ..... B27B 5/29

[52] U.S. Cl. ..... 83/425; 83/437; 83/477.2; 83/581; 403/395

[58] Field of Search ..... 403/395, 398, 399; 83/431, 437, 477, 477.1, 477.2, 581, 425

[56] References Cited

U.S. PATENT DOCUMENTS

| | | | |
|---|---|---|---|
| 2,208,358 | 7/1940 | Chandler | 403/395 X |
| 2,529,173 | 11/1950 | Moyer et al. | 403/395 X |
| 2,759,503 | 8/1956 | Goldschmidt | 269/165 X |
| 4,395,053 | 7/1983 | Kalfas | 403/395 X |

*Primary Examiner*—Frank T. Yost

*Attorney, Agent, or Firm*—Biebel, French & Nauman

[57] ABSTRACT

A miter gage having an adjustable workpiece clamp. The miter gage is of the type having a bar shaped to slidably engage a guideway of a tool work table, a protractor mounted on the bar and a grip mounted on the protractor. The clamping device includes a lock guide having a base adapted to be attached to the grip, a longitudinally-extending, vertical opening and a pair of opposing side walls; a U-shaped lock clamp having a sidewardly-opening channel receiving the lock guide and including a vertical bore positioned in registry with the lock guide opening, a lock rod extending vertically through the bore and opening and a lock knob having a stud which is threaded through the side of the lock clamp to bear against an adjacent sidewall of the lock guide. Displacement of the threaded stud relative to the lock clamp urges the lock guide sidewardly out of the channel and causes the lock rod to be urged against the lock guide, thereby preventing its relative movement. By selectively loosening or tightening the threaded stud against the sidewall of the lock guide, the lock rod may be alternately locked in position or released for vertical movement to an appropriate height above the associated work table to accommodate a particular workpiece.

5 Claims, 6 Drawing Figures

MITER GAGE

BACKGROUND OF THE INVENTION

The present invention relates to miter gages of the type adapted for use with power tool work tables and, more particularly, miter gages for use with power saw tables for holding a workpiece at a predetermined orientation for feeding into the saw blade extending through the saw table.

A miter gage is a device commonly used in combination with a table saw or band saw and is used to hold a workpiece during a crosscut operation. Such a miter gage typically includes an elongate bar which is shaped to slidably engage a groove formed in the tabletop of the saw table and extends in a direction parallel to the cutting plane of the tool mounted beneath the saw table. A protractor is mounted on the bar such that it pivots about a vertical axis and includes a flat face for engaging a workpiece.

To perform a crosscutting operation with such a miter gage, the workpiece is held against the face of the protractor and the miter gage is slid along the groove past the tool, which may be a rotating circular saw blade for a crosscutting operation, and the workpiece is cut by the tool. To perform a miter cut, the protractor portion of the miter gage is pivoted such that the workpiece-engaging face is disposed at the desired skewed or nonperpendicular angle to the plane of rotation of the tool. Consequently, a workpiece held against the face of the protractor and fed into the rotating saw blade is cut to have a beveled or angled end.

The better quality miter gages also include a work holding assembly which forms a part of the miter gage. For example, the Goldschmidt U.S. Pat. No. 2,759,503 shows a miter gage having a clamp in the form of a vertically adjustable lock rod which is supported by a lock guide extending outwardly from a grip mounted on the protractor. The lock rod comprises a threaded shaft having a disk-shaped shoe mounted on its lower end. The lock guide includes an elongate opening sized to receive an upper end of the lock rod and the elevation of the lock rod relative to the lock guide is adjusted by a pair of nuts threaded on the lock rod and positioned above and below the lock guide.

To adjust the elevation of the lock rod relative to the lock guide and thereby position the shoe at a predetermined height above the saw table, the nuts are displaced along the shaft of the lock rod away from the lock guide to allow the lock rod to be moved vertically relative to the lock guide. The lock rod may also be displaced relative to the lock guide by sliding the lock rod within the elongated opening. Once the lock rod is positioned at an appropriate elevation and location along the opening, the nuts are tightened against the upper and lower surfaces of the lock guide and thereby hold the lock rod in position relative to the lock guide.

To facilitate the rapid clamping and unclamping of the lock rod against a workpiece, the lock guide is attached to the lock lever which is pivotally attached to the grip and is linked to a trigger. By squeezing the trigger against the grip, the lock lever pivots relative to the grip and thereby moves the lock guide and lock rod slightly downwardly, thereby clamping a workpiece between the shoe and the saw table. The trigger is spring actuated such that when the grip is released from the hand of a user, the lock lever pivots the lock guide slightly upwardly so that the shoe is removed from engaging the workpiece.

While the aforementioned miter gage provides a safe and secure means for clamping a workpiece against the face of the protractor, the procedure for vertically adjusting the lock rod to accommodate workpieces of varying thicknesses is slow and relatively tedious. Four distinct operations must be performed: the upper and lower nuts must be individually moved away from the lock guide to allow the vertical movement of the lock rod, and the nuts must again be individually displaced against the lock guide to secure the lock rod once the lock rod has been positioned at the proper elevation.

Accordingly, there is a need for a miter gage having a work holding assembly in which the work holding piece may be adjusted in elevation to accommodate workpieces of differing heights in a rapid and easy manner. Furthermore, the workpiece engaging device must be relatively inexpensive to manufacture and reliable in operation.

SUMMARY OF THE INVENTION

The present invention is a miter gage having a workpiece holding assembly in which a lock rod may be clamped against or released from clamping engagement with a lock guide by the rotation of a single knob. The clamping assembly includes a lock clamp which slidably engages the lock guide and includes a vertical bore positioned in registry with the longitudinal opening of the lock guide. A lock knob includes a threaded stud which engages a threaded bore in a side portion of the lock clamp and bears against a sidewall of the lock guide. The lock rod extends through the vertical bore of the lock clamp and the opening of the lock guide.

To clamp the lock rod against the lock guide, the knob is rotated such that the threaded stud bears against the adjacent sidewall of the lock guide and urges the lock guide sidewardly away from the lock clamp. This urges the lock guide against the portion of the lock rod extending through the lock guide opening with sufficient force to prevent the vertical movement of the lock rod relative to the lock guide. To release the lock rod from its clamped engagement with the lock guide, the knob is turned in an opposite direction so that the threaded stud is displaced away from the sidewall of the lock guide, thereby releasing the portion of the lock rod extending through the opening from its engagement with the lock guide.

In a preferred embodiment, the lock clamp is in the form of a U-shaped channel having a sideward opening and comprising top and bottom members joined by a side member. The channel is shaped to receive the lock guide and the top and bottom members include the vertical bore. The side member includes the threaded bore which receives the threaded stud of the lock knob.

The lock guide is elongate in shape and includes a pair of opposing side walls which are substantially flat and provide a bearing surface to be engaged by the end of the threaded stud. With this specific design of the lock clamp and lock guide, the lock clamp may be positioned so that the side member, and hence the lock knob, is on the left or right side of the lock guide to accommodate a right-handed or left-handed user.

Accordingly, it is an object of the present invention to provide a miter gage with a work clamping assembly having a vertically positionable lock rod that can be locked at a predetermined elevation above the work table with a single adjustment; a miter gage having a clamping assembly which is relatively simple in construction and is capable of withstanding rugged use; and a miter gage having a locking assembly which may be adapted easily for use by a right-handed or a left-handed user.

Other objects and advantages of the invention will be apparent from the following description, the accompanying drawings and the appended claims.

DETAILED DESCRIPTION OF THE PREFERRED EMBODIMENT

Figure 1:
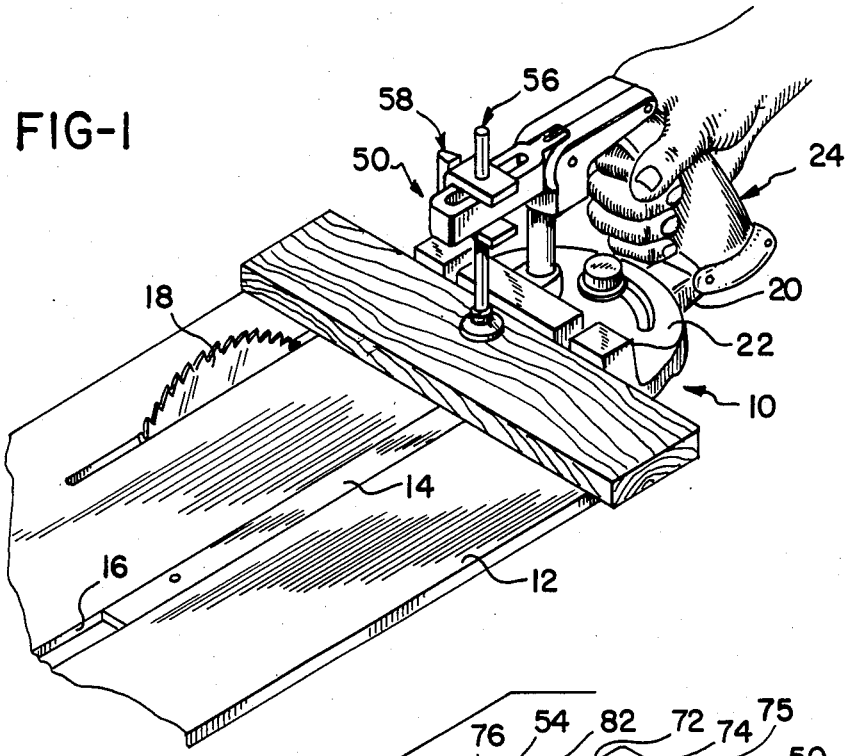
FIG. 1 is a perspective view of the miter gage of the present invention mounted on a tabletop and holding a workpiece, the tabletop being shown broken away.

As shown in FIG. 1, the miter gage of the present invention, generally designated 10, is designed to be used in combination with the tabletop 12 of a woodworking tool, such as a table saw. The miter gage 10 includes an elongate bar 14 which is shaped to slideably engage a slot 16 formed in the tabletop and extending parallel to the plane of the saw blade 18. The bar 14 is attached to a pedestal 20 and is pivotally attached to a protractor body 22, both of which have flat undersides for sliding acros the tabletop 12.

Figure 3:
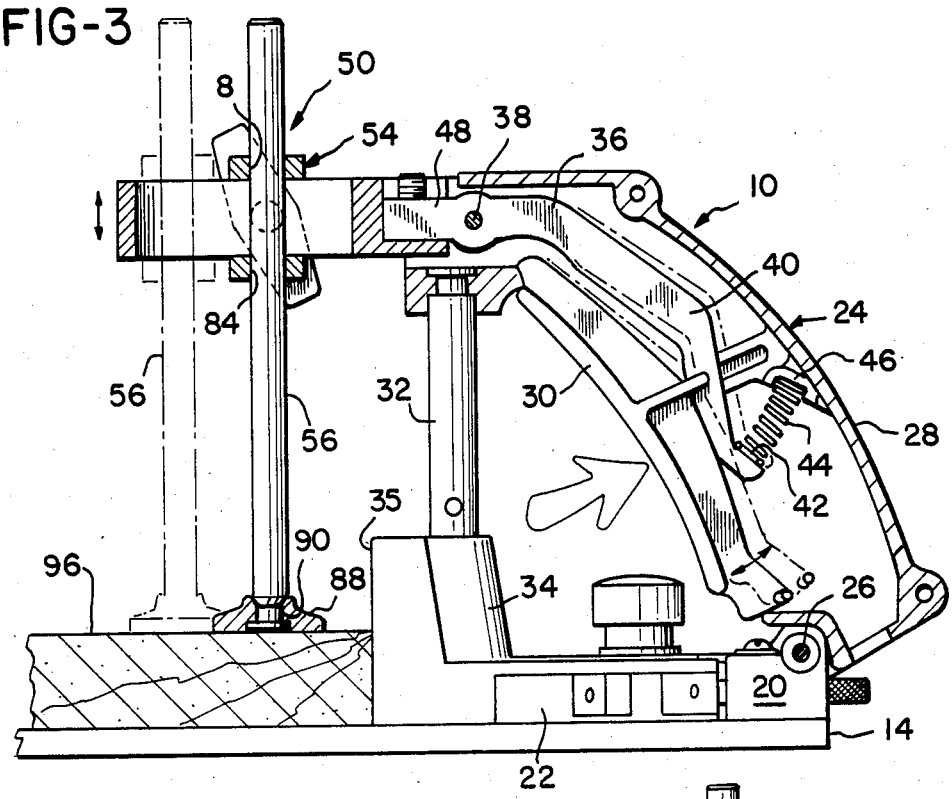
FIG. 3 is a side elevational view, partly in section, of the miter gage of FIG. 1, showing the lock rod in a displaced position in phantom.
Figure 4:
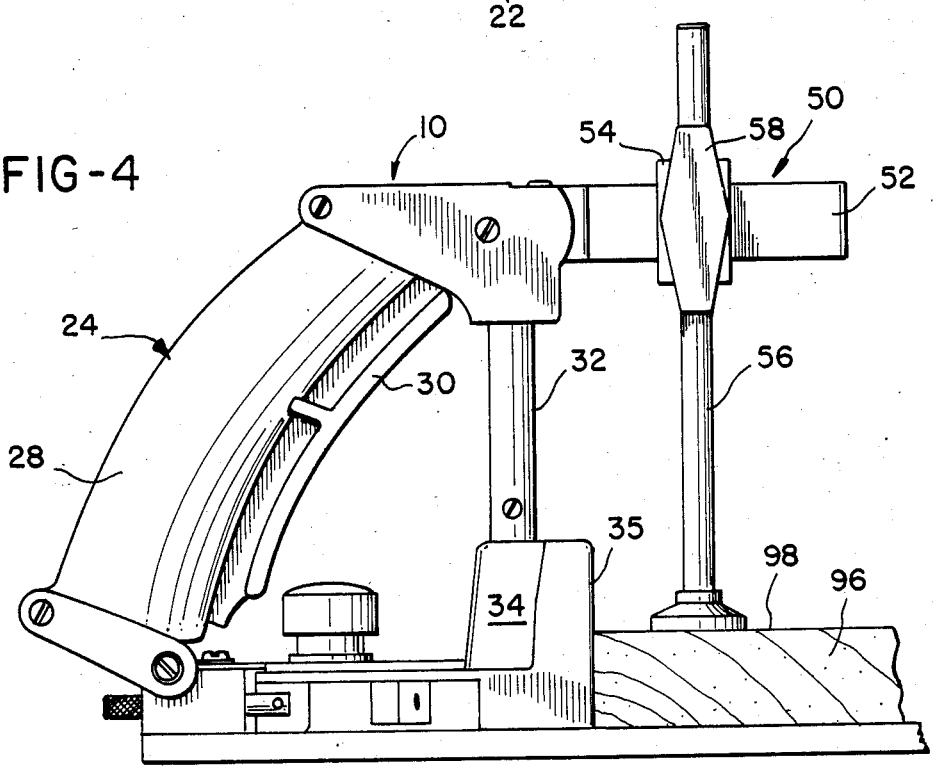
FIG. 4 is a side elevational view of the miter gage of FIG. 1.

A grip portion, generally designated 24, is attached to the pedestal 20 by a screw 26 and includes a two-piece handle 28 which slideably receives a trigger 30. The upper portion of the handle 28 receives the upper end of a cylindrical stud 32 which is threaded at a lower end into the top of a work abutment 34 of the protractor body (FIGS. 3 and 4). Work abutment 34 includes a flat face 35 oriented substantially vertically.

An elongate lock lever 36 is pivotally attached to the handle 28 by screw 38 and nut 39 and includes a lower end 40 extending through the handle and terminating in a spring seat 42. A coil spring 44 engages the coil seat 42 and is seated at its opposite end in a recess 46 formed in the handle 28. The spring 44 biases the lower end 48 of the lock lever 36 outwardly against the trigger 30.

The structural details of the bar 14, pedestal 20, protractor body 22, handle 24 and stud 32 are shown and described in the Goldschmidt U.S. Pat. No. 2,759,503, the disclosure of which is incorporated by reference.

Figure 2:
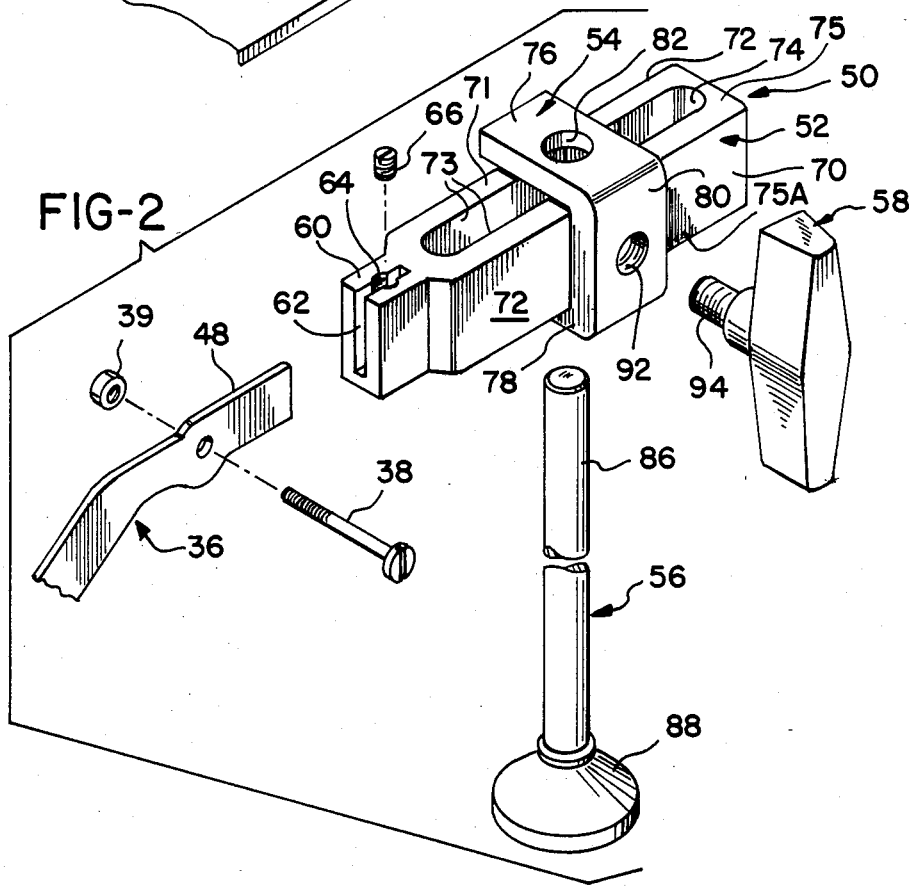
FIG. 2 is a detail in perspective of the miter gage of FIG. 1, showing an exploded view of the locking mechanism.

As shown in FIGS. 2 and 3, the upper end 48 of the lock lever 36 is attached to a locking assembly, generally designated 50. The locking assembly 50 includes a lock guide 52, a lock clamp 54 which slideably engages the lock guide, a lock rod 56 and a lock knob 58. The lock guide 52 includes a base 60 having a vertical slot 62 formed therein which is shaped to receive the upper end 48 of the lock lever 36. The upper end of the slot 62 includes a threaded bore 64 that receives a set screw 66, so that the set screw may be threaded downwardly to clamp the upper end 48 against the bottom 68 of the slot 62. The lock guide 52 includes a pair of opposing side walls 70, 71, each having a flat outer surface 72 and a flat inner surface 73. The inner surfaces 73 together define an elongate, vertical opening 74. The lock guide 52 also includes flat, parallel upper and lower surfaces 75, 75A oriented at right angles to the inner and outer surfaces 72, 73 (see also FIGS. 5 and 6).

Figure 6:
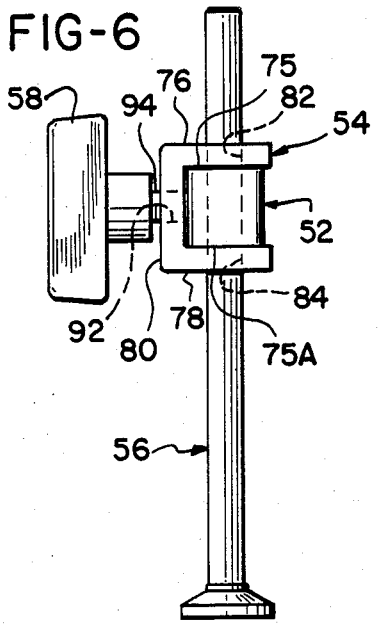
FIG. 6 is a front elevational view of the locking assembly of the miter gage of FIG. 1.

The lock clamp 54 is generally U-shaped and includes a top member 76, a bottom member 78 and a side member 80 (see also FIG. 6). The side member 80 extends between the top and bottom members and the three members together form a sidewardly-opening channel. The top and bottom members each include a vertically-extending bore 82, 84 (see also FIGS. 2 and 6).

The bores 82, 84 and opening 74 are sized to receive the cylindrical shank 86 of the lock rod 56 such that the lock rod is held perpendicular to the bar 14. The lock rod 56 also includes a foot 86, which is disc-shaped and is rotatably attached to a lower extention 90 of the lock rod by an interference fit.

Figure 5:
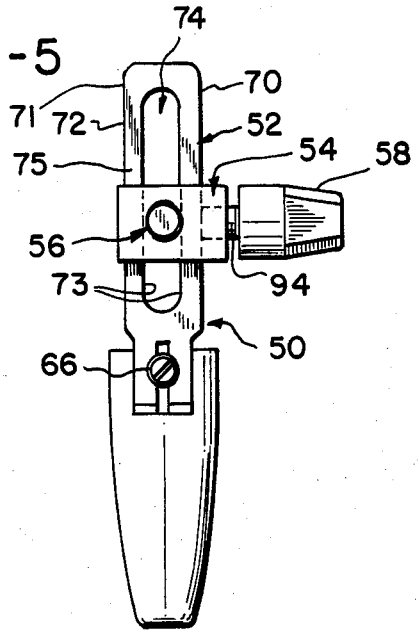
FIG. 5 is a detail top plan view of the miter gage of FIG. 1.

The side member 80 includes a threaded bore 92 which receives the threaded shank 94 of the lock knob 58. The threaded shank 94 is sized to extend through the threaded bore 92 and bears against the adjacent sidewall 70 of the lock guide 52, as shown in FIG. 5.

The operation of the miter gage 10 is as follows. Depending on the type of cut to be made, the protractor 22 may be pivoted to place the work abutment face 35 at a skewed angle relative to the cutting plane of the tool blade 18. In order to lock the lock rod 56 to the lock guide 52, the lock clamp 54 is first positioned on the lock guide so that the lock guide extends through the channel portion of the lock clamp and the bores 82, 84 are in registry with the opening 74 of the lock guide, as shown in FIG. 2. The shank 86 of the lock rod 56 is then inserted through the bores 82, 84 and the opening 74, as shown in FIGS. 3 and 4. At this time, the lock clamp 54 is loosely secured to the lock guide 52 since the shank 86 prevents the separation of the lock clamp from the lock guide. The lock clamp 54 is free to be displaced along the lock guide 52 so that the shoe 88 and lock rod 56 is at an appropriate distance from the work abutment face 35 for the particular workpiece. The elongate shape of the opening 74 enables the lock rod 56 to be displaced with the lock clamp 54 relative to the lock guide 52.

Once positioned along the lock guide 52, the lock rod 56 is then displaced upwardly relative to the bar 14, thereby raising the shoe 88 above the bar and tabletop 12 (FIG. 1), and locked in position. It is desirable to raise the shoe 88 above the tabletop a distance in excess of the thickness of the workpiece 96 to be gripped by the miter gage 10 to facilitate placement of the workpiece against the work abutment face 35.

To lock the lock rod to the lock guide 52, the lock knob 58 is rotated, thereby threading the shank 94 of the lock knob into the threaded bore 92 (FIG. 6). The end of the shank 94 bears against the sidewall 70 of the lock clamp 54 and displaces the lock clamp sidewardly relative to the lock guide 52. This sideward displacement of the lock clamp 54 draws the shank 86 of the lock rod 56 sidewardly against the adjacent inner wall 75 of the opening 74, and it is this frictional engagement that locks the rod to the lock guide and prevents the relative vertical movement of the lock rod.

Once the workpiece 96 has been positioned beneath the shoe 88 and against the face 35, the knob is rotated in a reverse direction to draw the shank 94 away from the sidewall 70 to release the lock rod 56 from its engagement with the inner wall of the opening 74, thereby allowing the shoe to drop downwardly and rest upon the upper surface 98 of the workpiece. The knob 58 is again rotated to lock the lock rod 56 to the lock guide 52 in the manner previously described in order to secure the workpiece firmly against the work abutment body 34 and the upper surfaces of the bar 14 and tabletop 12.

The workworking tool on which the miter gage 10 is mounted may then be actuated and the miter gage displaced along the tabletop 12 so that the workpiece 96 engages the saw blade 18 of the tool to perform a cut. When the user grips the handle 28 and squeezes the trigger 30, as shown in FIG. 1, the lock lever 36 pivots to urge the lock guide 52 downwardly, and hence the lock rod 56 downwardly against the workpiece 96 to hold it in place against the work abutment face 35.

In order to accommodate the personal preference of a user, the locking mechanism 50 may be disassembled and reassembled such that the lock clamp 54 engages the lock guide 52 in the opposite sense shown in FIGS. 1–6, so that the bore 92 and side member 80 are adjacent to sidewall 72, rather than sidewall 70 as shown in the figures.

While the form of apparatus herein described constitutes a preferred embodiment of this invention, it is to be understood that the invention is not limited to this precise form of apparatus, and that changes may be made therein without departing from the scope of the invention.

What is claimed is:

1. In a miter gage of the type having an elongate bar shaped to slidably engage a guideway of a tool work table, protractor means mounted on said bar, and grip means mounted on said protractor means, the improvement comprising:

a lock guide having a pair of opposing side walls, each having flat inner and outer surfaces and flat upper and lower surfaces, said inner surfaces defining an opening therebetween extending between said upper and lower surfaces;

a lock clamp having substantially a U-shape and including a flat top member shaped to overlie and abut said upper surface, a flat bottom member shaped to overlie and abut said lower surface, and a flat side member shaped to overlie and abut said outer surface of a selected one of said side walls, such that said lock clamp forms a channel receiving said lock guide for relative sliding movement, but is constrained from relative pivotal movement, and said top and bottom members including bores positioned in registry with said opening;

a rod oriented substantially perpendicularly to said bar and extending through said bores and opening; and lock means for urging said lock guide sidewardly within said channel away from said side members against said rod, whereby said rod is constrained from being displaced relative to said lock guide and lock clamp.

2. The miter gage of claim 1 wherein said lock means includes a threaded bore through said side member into said channel; and a threaded stud extending through said threaded bore and engaging said outer surfaces of said selected side wall such that displacement of said stud into said threaded bore causes said stud to bear against said selected side wall and urge said lock guide sidewardly out of said channel.

3. The miter gage of claim 2 wherein said lock means includes a knob for turning said threaded stud in said threaded bore.

4. The miter gage of claim 1 wherein said opening is an elongate in shape such that said lock clamp and said rod are displaceable therealong.

5. The miter gage of claim 1 wherein said lock guide includes a base having a slot extending vertically therein and including a bottom surface and a set screw bore at an upper end thereof, and a set screw in said set screw bore; and said grip means includes a lock lever having an end positioned in said vertically-extending slot and held against said bottom surface by said set screw.

* * * * *